United States Patent [19]

Edamula

[11] Patent Number: 4,837,414

[45] Date of Patent: Jun. 6, 1989

[54] OVEN WITH ELECTRONIC REMOTE CONTROLLER

[75] Inventor: Kaoru Edamula, Nara, Japan

[73] Assignee: Sharp Kabushiki Kaisha, Osaka, Japan

[21] Appl. No.: 131,284

[22] Filed: Dec. 10, 1987

Related U.S. Application Data

[63] Continuation of Ser. No. 855,496, Apr. 23, 1986, abandoned.

[51] Int. Cl.[4] ..... H05B 6/64

[52] U.S. Cl. ..... 219/10.55 B; 219/506; 219/10.55 R; 99/325; 235/462; 340/825.22; 341/175

[58] Field of Search ..... 219/10.55 B, 10.55 R, 219/506, 487, 412–414, 488, 490; 99/325; 235/462, 472; 340/825.69, 825.72, 870.16, 870.17, 696, 539; 364/477

[56] References Cited

U.S. PATENT DOCUMENTS

| | | | |
|---|---|---|---|
| 4,131,786 | 12/1978 | Cooper | 219/10.55 B X |
| 4,323,773 | 4/1982 | Carpenter | 219/10.55 R X |
| 4,339,646 | 7/1982 | Doi et al. | 219/10.55 B |
| 4,340,797 | 7/1982 | Takano et al. | 219/10.55 B |
| 4,398,651 | 8/1983 | Kumpfer | 219/10.55 R |

*Primary Examiner*—Philip H. Leung
*Attorney, Agent, or Firm*—Flehr, Hohbach, Test, Albritton & Herbert

[57] ABSTRACT

An electronically controlled oven comprises a main body and a remote controller which is separate from said main body. The remote controller includes a scanner for scanning a code representing a recipe and outputting a code signal indicative of the selected recipe, a computer for judging whether this code signal should be transmitted to the main body or not, and a transmitter for transmitting code signals in a wireless form such as by infrared radiation. The main body includes a receiver for receiving the signals from the remote controller and converting it into an electric code signal, memories for storing cooking programs, a main computer for retrieving from the memories a particular cooking program corresponding to the selected recipe and outputting heater-controlling signals according to this particular cooking program, a cooking chamber, heaters for heating items inside this cooking chamber, and a heater-control device for controlling the operation of the heaters according to the heater-control signals from the main computer. This oven makes it easy for the user to set correctly for a large variety of cooking programs.

14 Claims, 6 Drawing Sheets

OVEN WITH ELECTRONIC REMOTE CONTROLLER

Figure 1:
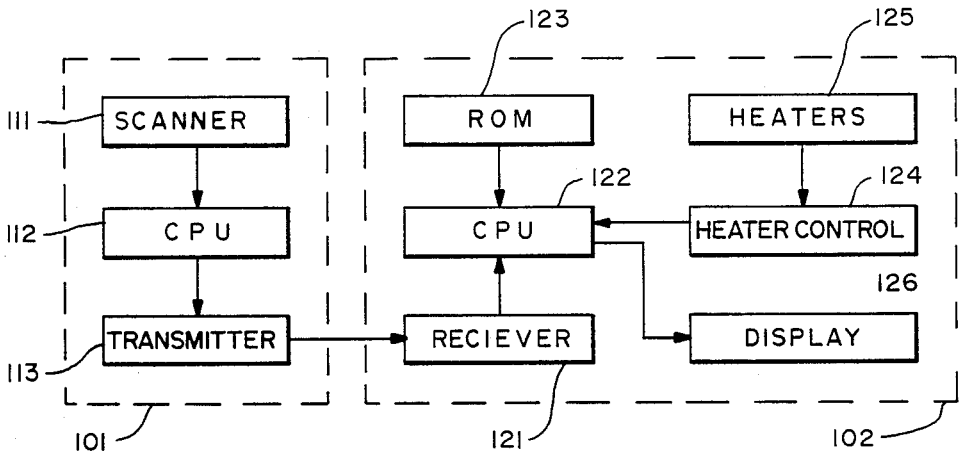

This invention relates to an electronically controlled oven and more particularly to an oven for cooking which is controlled by a microcomputer and combines microwave heating and conventional convection heating.

In order to be able to process many kinds of foods according to a variety of recipes, a cooking oven employs both microwave and convection heating methods and is equipped with many buttons and knobs as well as a timer on the front panel so that the user can either depend on his or her memory based on experience or consult a cookbook to set the oven by operating these buttons. A conventional cooking oven of this type, however, has the following disadvantages. Firstly, there is nowadays a great number of cookbooks and recipes available and this makes it difficult for an ordinary user depending on experience alone to set the oven properly each time. Errors are therefore committed frequently in operating the oven. Secondly, many of the cooking instructions are considerably complicated. Although cookbooks are available, it is usually troublesome to consult one for an instruction and then set the oven accordingly. Thirdly, the user is frequently obliged to stay near the oven and/or keep monitoring the progress which is taking place inside the oven, if, in particular, the cooking program being followed is complicated, including many stages. Fourthly, preheating is frequently required and this makes the user's job additionally cumbersome. In a typical situation, the user will put items to be cooked inside after a preheating period, pull out the oven rack after a certain period to flip over some of the items, and so on such that it is not safe for the user to leave the kitchen once the cooking is started. In order to roast a 4-pound piece of frozen beef for a dinner for eight persons, for example, it will take about two hours inclusive of the time of defrosting the meat and the oven must be set three or four times during the course.

It is therefore an object of the present invention to provide a cooking oven which can be set easily and correctly by an ordinary user for a large variety of cooking programs.

It is another object of the present invention to provide a cooking oven with which the user can monitor the progress of cooking even from a distance.

The above and other objects of the present invention are achieved by providing an electronically controlled oven having a remote controller which is physically separable from the main body of the oven such that control signals can be exchanged between them by infrared radiation. The main body includes a control unit equipped with a microcomputer and its control programs are stored in a ROM means. Cooking programs written in bar code are read by an optical bar code scanner which is made a part of the remote controller and are transmitted to the control unit where a proper computer control program corresponding to the inputted cooking program is retrieved from the ROM means. A heater-control means is then operated according to this computer control program to heat the oven.

Figure 2:
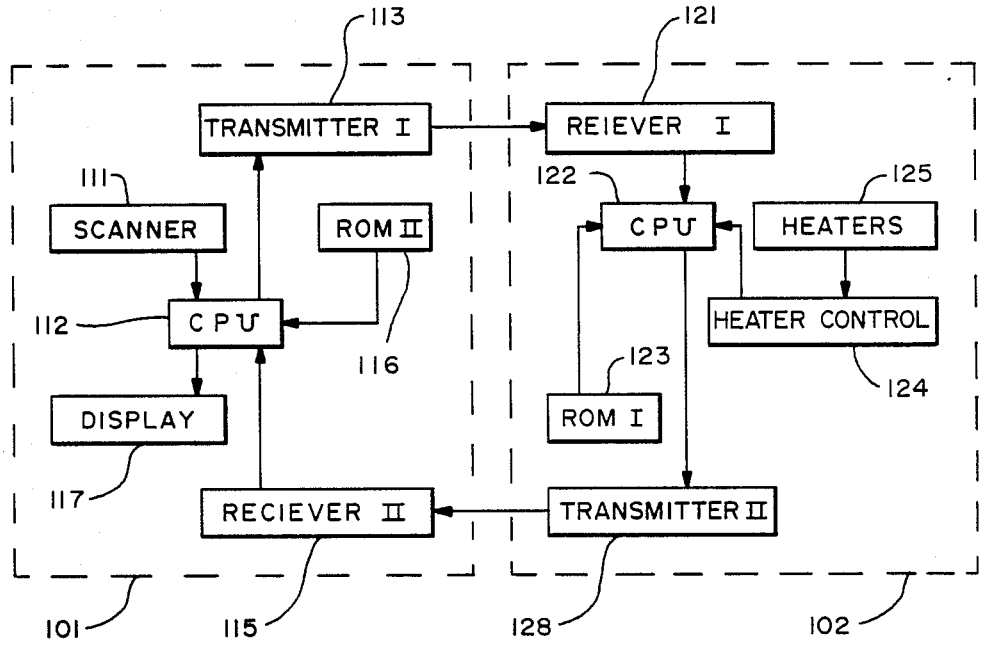
Figure 3A:
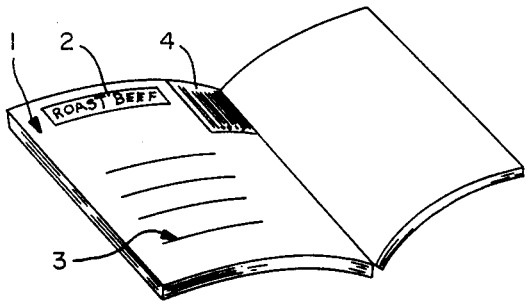
Figure 3B:
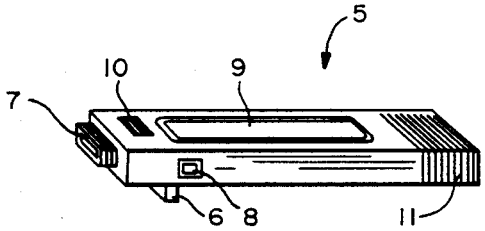
Figure 3C:
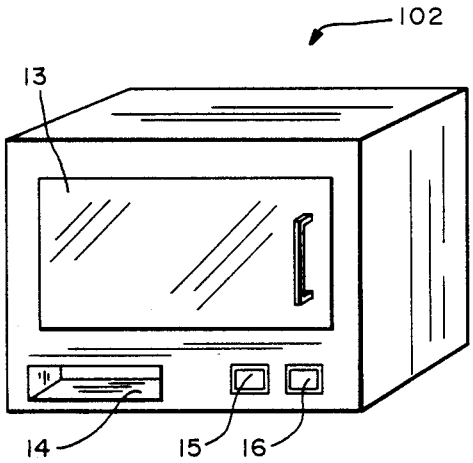
Figure 4:
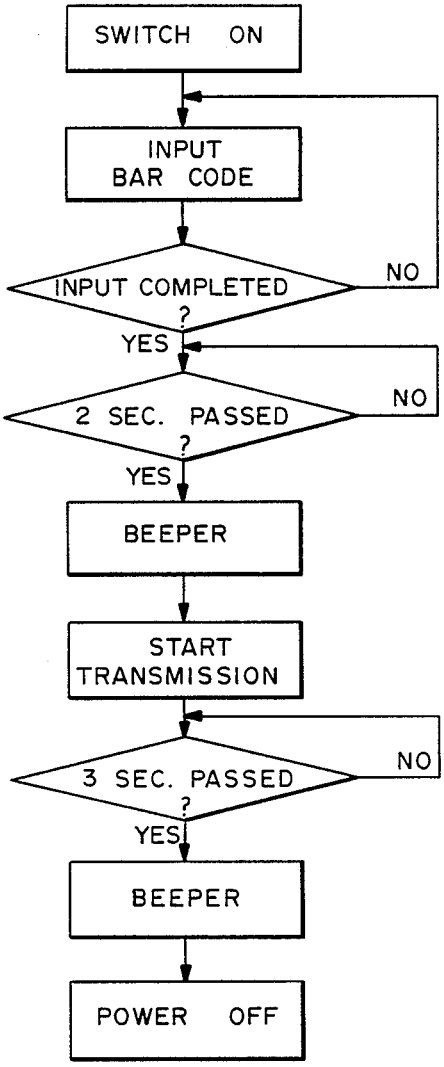
Figure 5A:
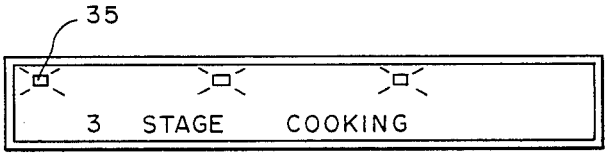
Figure 5B:
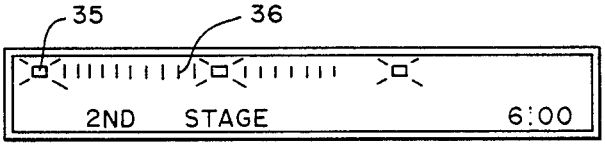
Figure 5C:
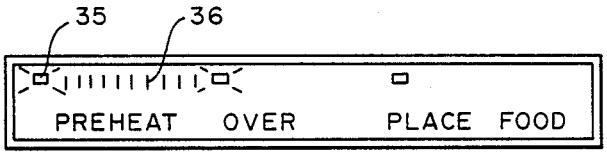
Figure 8:
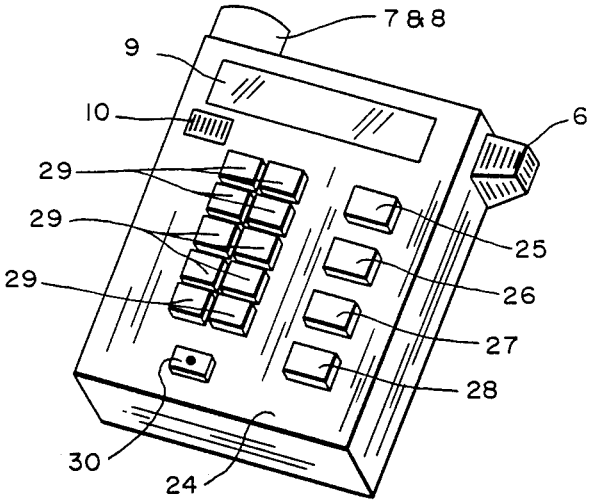
Figure 6:
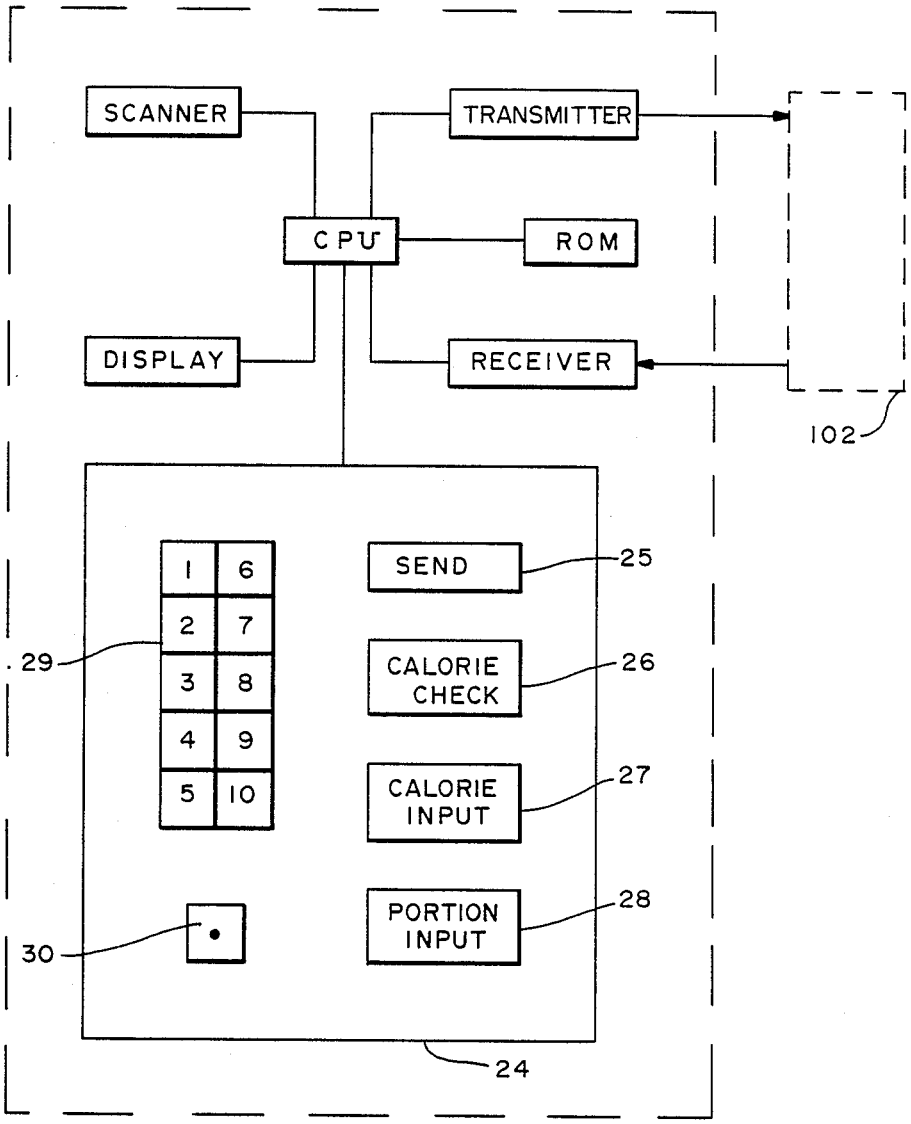
Figure 7:
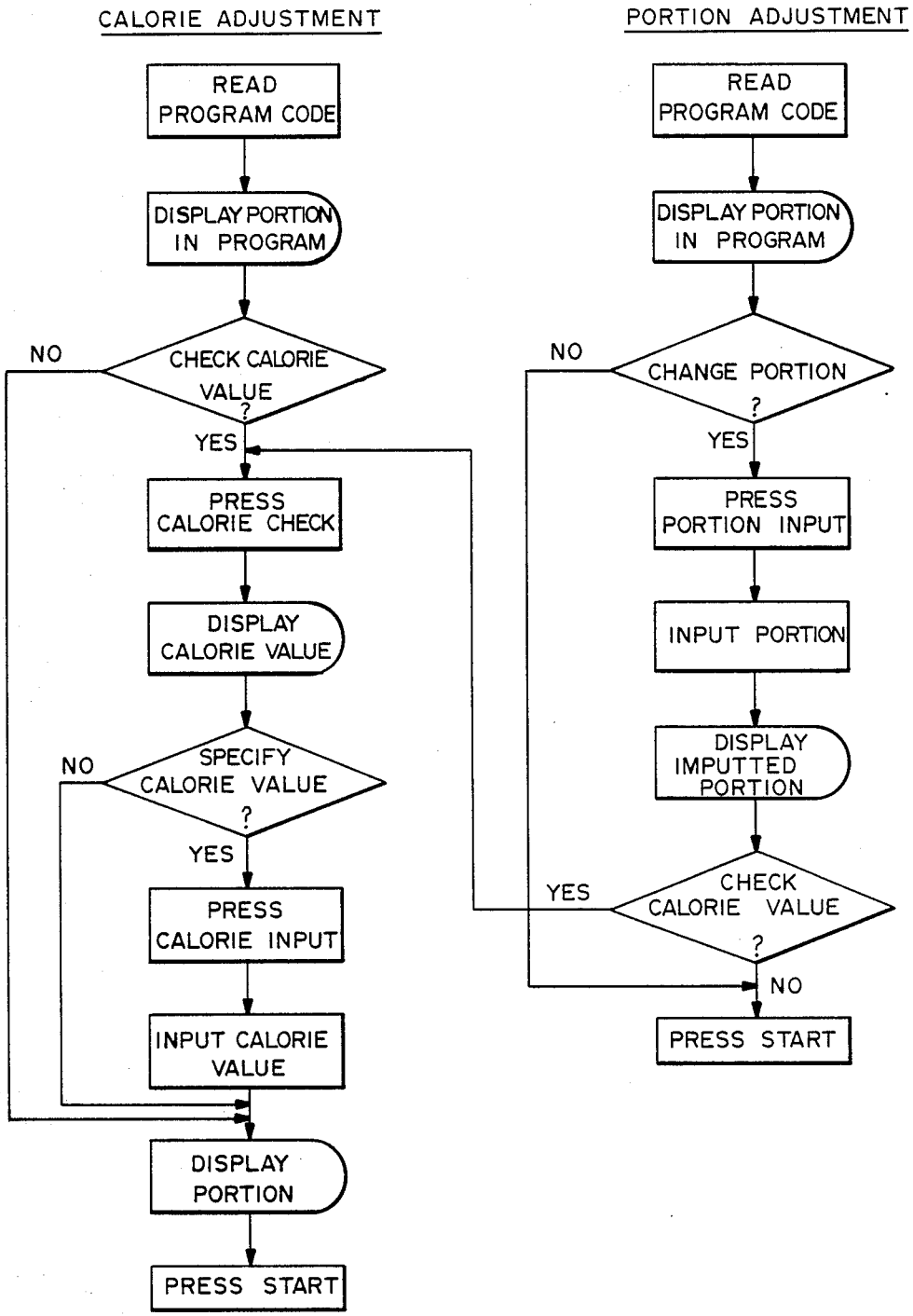
Figure 9A:
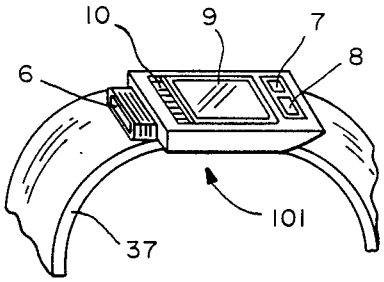
Figure 9B:
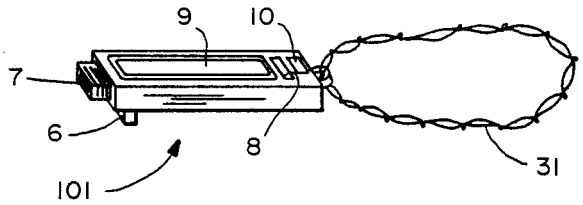
Figure 10A:
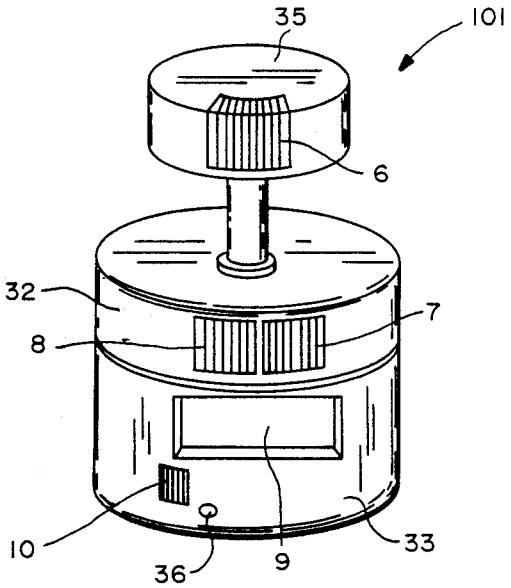
Figure 10B:
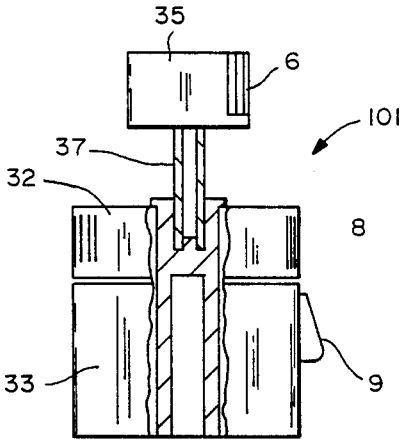

The accompanying drawings, which are incorporated in and form a part of the specification, illustrate a few embodiments of the present invention and, together with the description, serve to explain the principles of the invention. In the drawings:

FIG. 1 is a block diagram showing the structure of an electronically controlled oven according to one embodiment of the present invention, FIG. 2 is a block diagram showing the structure of an electronically controlled oven according to another embodiment of the present invention, FIGS. 3A, 3B and 3C are perspective views respectively of a cookbook, a remote controller and an oven described in FIG. 2, FIG. 4 is a flow chart for the operation of the remote controller transmitting a signal according to an inputted bar code, FIGS. 5A, 5B and 5C are examples of displays by the display means, FIG. 6 is a block diagram showing the structure of an electronically controlled oven according to a still another embodiment of the present invention, FIG. 7 is a flow chart for correcting a cooking program according to a desired number of portions or calorie value, FIG. 8 is a perspective view of a remote controller of FIG. 6, FIG. 9A is a perspective view of a remote controller of the present invention designed to be carried around the wrist, FIG. 9B is a perspective view of another remote controller of the present invention designed to be hung from the neck, FIG. 10A is a perspective view of a remote controller of desk-top type embodying the represent invention, and FIG. 10B is a sectional view of the remote controller of FIG. 10A.

A conventional cooking oven of the so-called touch control type includes in its main body a control unit, input means such as buttons by which the user selects a mode of operation, display means for displaying whatever information intended to be addressed to the user, and warning means for warning the user. Stated briefly, some of the functions performed by these constituent parts are physically separated from the main body according to the present invention and are put together in a remote controller. The main body includes a cooking chamber of a known type adapted possibly for both microwave and convection type heating. Means for heating this chamber according to an inputted signal are also contained in the main body. The remote controller, on the other hand, is intended to be carried by the user and includes input means and transmitting means for transmitting the information inputted by the user to the control unit in the main body.

The composition of an electronically controlled oven according to one embodiment of the present invention is explained below more in detail by way of a block diagram shown in FIG. 1 wherein numerals 101 and 102 respectively indicate a remote controller and a main body which, as described above, are physically separable. The remote controller 101 includes a scanner means 111, a microcomputer functioning as judging means 112 and a transmitter means 113. The scanner means 111 is for optically reading a bar code and may be of a type already well known in the art. The judging means 112 serves to examine the bar code inputted through the scanner means 111 to determine whether the inputted code is of a correct format for transmission to the main body 102. If, and only if, the inputted code is found acceptable by the judging means 112, the transmitter means 113 is activated and transmits an infrared signal indicative of the code inputted through the scanner means 111 and found acceptable by the judging means 112. The signal is typically transmitted several times repeatedly.

The main body 102 includes a receiver means 121 for receiving the infrared signals from the transmitter means 112 of the remote controller 101 and converting it into an electrical signal. This electrical signal is transmitted to a control means 122 which may comprise a microcomputer and serves to retrieve from a memory means 123 a computer cooking program which corresponds to the received electrical signal. The retrieved cooking program contains various information such as how hot the cooking chamber should be and how the long the heating should continue. The control means 122 then causes a heater-control means 124 to activate heating means 125 according to the information contained in the retrieved computer cooking program. Some relevant information useful to the user is concurrently displayed by a display means 126 in response to instructions which are also contained in the retrieved computer cooking program. The display means 126 may comprise a fluorescent tube or a liquid crystal. A sound-making device such as a beeper as a warning means may also be made a part of the display means 126. The signal transmission from the transmitter means 113 to the receiver means 121 may be by ultrasonic waves. The remote controller 101, although separable from the main body 102, may be adapted for storage inside a box-like compartment formed in the main body 102 when it is not being used. As will be explained below, the scanner means 111 may be formed as a separable part of the remote controller 101.

The composition of an electronically controlled oven according to another embodiment of the present invention is shown in FIG. 2 wherein corresponding components are indicated by the same numerals as explained in connection with FIG. 1. The main difference between the oven shown in FIG. 1 and the one shown in FIG. 2 is that display of information to the user is made on the remote controller 101 instead of the main body 102. Thus, the remote controller 101 according to this embodiment is provided with a display means 117.

Reference being made to FIG. 2, the scanner means 111, the judging means 112 and the first transmitter means 113 of the remote controller 101 and the first receiver means 121 of the main body 102 serve the same functions as explained in connection with FIG. 1. According to the embodiment shown in FIG. 2, however, the main body 102 is provided with a second transmitter means 128 and the remote controller 101 with a second receiver means 115 such that display information, which is a part of the computer cooking program retrieved from the memory means 123, is transmitted from the control means 122 to the second transmitter means 128. Transmission of signals from the second transmitter means 128 to the second receiver means 115 is effected as from the first transmitter means 113 to the first receiver means 121. When a signal indicative of the aforementioned display information is thus received by the remote controller microcomputer 112, an image to be displayed is retrieved from a second memory means 116 in accordance with the display information received from the main body control means 122 and is displayed by the display means 117 which is on the side of the remote controller 101 in this embodiment.

An electronically controlled oven described above by the block diagram of FIG. 2 may appear as shown by FIG. 3 wherein numeral 1 indicates a cookbook which is adapted for use with this oven and contains for each recipe a title 2, a written explanation 3 and a bar code 4 associated with it. Numeral 101 again indicates the remote controller. According to the particular embodiment illustrated in FIG. 3, the remote controller 101 is intended to be carried by hand and is shaped like a box, including an optical bar code scanner 6 (corresponding to numeral 111 of FIG. 2) for scanning and reading bar codes in a well known manner, an infrared signal transmitter 7 (corresponding to numeral 113 of FIG. 2) for transmitting infrared signals, an infrared signal receiver 8 (corresponding to the second receiver means 115 of FIG. 2) for receiving infrared signals, a liquid crystal display board 9 (corresponding to numeral 117 of FIG. 2) of a known type, a beeper 10 and a handle 11. Numeral 102 again indicates the main body part of the oven, including a door 13 to the cooking chamber, a box-like compartment 14 for storing the remote controller 101 when not in use, an infrared receiver 15 corresponding to the first receiver means 121 of FIG. 2 and an infrared transmitter 16 corresponding to the second transmitter means 128 of FIG. 2.

When the user selects a cooking program in the cookbook 1 and presses a START button (not shown) on the remote controller 101, the remote controller microcomputer 112 gets ready as shown by the flow chart of FIG. 4. When the bar code 4 identifying a recipe is scanned, the inputted bar code signal is examined by the microcomputer functioning as the judging means 112 as explained above to determine whether the inputted code is acceptable for transmission. There is a waiting period of two seconds after the bar code 4 is inputted and the beeper 10 makes a sound to notify the user that the main body control system 122 is about to be informed which cooking program has been selected by the user. The transmitter 7 transmits an infrared signal a predetermined number of times (such as three times) according to the selected cooking program, or the inputted bar code indicative thereof. The end of transmission from the transmitter 7 is reported to the user by another sound from the beeper 10 three seconds later, and power to the remote controller 5 is thereafter automatically shut off.

As explained above in connection with FIG. 2, the infrared signal received by the first receiver 121 in the main body 102 is transmitted to the control means 122 and information related to the selected cooking program is retrieved from the first memory means 123. The control means 122 then not only instructs the heater-control means 124 how to switch on and off the heater means 125 but also outputs display signals to the remote controller 101 on the basis of the aforementioned display information retrieved from the first memory means. These display signals are outputted from time to time according to the selected cooking program. When a display signal is received by the remote controller microcomputer 112, a search is made in the second memory means 116 and a display to be made according to this display signal is retrieved therefrom and displayed by the display means 117.

Examples of display made by the display means 117 are shown in FIG. 5. According to the format illustrated therein, the temporal progress in the cooking program is indicated by bold line symbols 35 and slim line symbols 36. The interval between two bold line symbols 35 represents one stage in the program and each stage is divided into 10 equal periods by slim line symbols. When information related to a selected cooking program is retrieved from the first memory means 123, the number of stages required in the program is displayed not only by character and number symbols at the center of the display means 117 but also by the number of bold line symbols that blink as shown in FIG. 5A. This is effected by the main body control means 122 outputting a coded display signal for this specific display and the remote controller microcomputer 112 decoding this signal as explained above.

As time goes by, the level of progress within the current stage is indicated for each 10% of the way by a new slim line symbol. FIG. 5B, for example, shows that the second stage is 70% completed because there are seven slim line symbols showing on the right-hand side of the second bold line symbol. The length of remaining time in the stage is also shown in units of minutes. At the end of each stage, the beeper 10 makes a sound several times to notify the user and a message such as "PREHEAT OVER", "CONVECTION OVER" and "DEFROST OVER" appears at the same time, indicating which stage has just come to an end. An instruction to the user such as "PLACE FOOD" and "TURN OVER" may also be made to appear as shown in FIG. 5C. In other words, each computer cooking program retrieved from the first memory means 123 contains a timing program according to which not only does the heater-control means 124 operate the heater means 125 but also display signals are outputted from the main body control means 122 such that correct displays are made by the display means 117 in correct time sequence.

The composition of an electronically controlled oven according to still another embodiment of the present invention is shown in FIG. 6. An oven according to this embodiment is characterized as being able to assist the user in making adjustments on the cooking programs as written in the cookbook 1 according to the desired number of portions or calorie values. For example, if the cookbook 1 shows a recipe for two persons but the user wishes to cook for three persons or to limit the total calorie value to a certain level, an oven according to this embodiment allows the user to input such information and makes adjustments automatically according to the inputted information.

Reference being made to FIG. 6, numerals 101 and 102 again indicate respectively a remote controller and a main body as before. The structure of the main body 102 is essentially the same as shown in FIG. 2, except the first memory means 123 must contain a different set of data as will become apparent below. The remote controller 101 according to this embodiment is different from that of FIG. 2 in that there is now provided an input means 24 which is connected to the remote controller microcomputer 112 and includes various input buttons such as a SEND button 25 for causing a command to be transmitted from the transmitter 113, a CALORIE CHECK button 26 for checking the food items and quantities mentioned in the cooking program inputted from the main body 102 through the receiver 115, a CALORIE INPUT button 27 to be used when the user wishes to input a desired calorie value by number buttons 29 and a decimal button 30, and a PORTION INPUT button 28 for similarly specifying the desired number of portions. Other than the above, the oven according to this embodiment is practically identical to that shown by FIG. 2. The method of using the oven of FIG. 6 and the data to be stored in its memory means are explained next by way, in part, of the action flow chart shown in FIG. 7. Let us first consider a situation where the user wishes to modify a cooking program in the cookbook 1 by specifying a calorie value. As soon as a recipe is selected by the user and a signal indicative thereof is inputted to the main body control unit by scanning its bar code as described above, the number of portions for which the program is written in the cookbook is displayed. In other words, such information is additionally stored in the memory means and the main body control means is programmed to cause its display by the display means 117. If the user presses the CALORIE CHECK button 26 at this point, the calorie value corresponding to that portion is displayed. If this value is different from the calorie value desired by the user, the user inputs the desired calorie value by means of the number and decimal buttons 29 and 30 and then presses the CALORIE INPUT button 27. The remote controller microcomputer 112 then compares the inputted calorie value with the value according to the recipe as written in the cookbook and automatically modifies the cooking program. The number of portions corresponding to the inputted calorie value is displayed by the display means 117. If the user then presses the SEND button 25, a start signal is transmitted through the transmitter 113 to the main body control means and the heater-control means is operated and display signals are subsequently outputted back to the remote controller 101 according to this modified cooking program. If the SEND button 25 is pressed directly without first specifying the calorie value by pressing the CALORIE CHECK button 26, the computer cooking program as originally stored in the main body memory means is directly relied upon to control the operation of the heater means.

Let us consider next a situation where the user wishes to modify the cooking program in terms of the number of portions. As explained above, the number of portions for which the selected cooking program is written and stored in the memory means is displayed by the display means 117 as soon as the user selects a recipe and inputs a bar code signal. If the displayed number of portions is different from the number desired by the user, the user presses the PORTION INPUT button 28 and inputs the desired number of portions such as 1.5 by means of the number and decimal buttons 29 and 30. This number is then displayed by the display means 117 and if the user then presses the START button 25, a signal carrying the message inputted by the user is transmitted from the transmitter 113 to the main body control means which modifies the retrieved cooking program accordingly and controls the heater-control means and outputs display signals back to the remote controller 101 according to the modified program. If the user presses the CALORIE CHECK button 26 instead of the START button 25, the corresponding calorie value appears on the display mans 117 and the user is allowed to further correct the input. FIG. 8 is a perspective view of a remote controller 101 of FIG. 6 according to one embodiment. Components explained above are indicated by the same numerals.

The foregoing description of preferred embodiments of the invention has been presented for purposes of illustration and description. It is not intended to be exhaustive or to limit the invention to the precise form disclosed, and obviously many modifications and variations are possible in light of the above teaching. For example, the remote controller 101 need not be formed in the shape of a box as illustrated in FIG. 3. It may be constructed in the form of a wristwatch as shown in FIG. 9A such that the user can wear it with a band 37. Alternatively, it may be made like a pendant as shown in FIG. 9B such that the user can hang it around the neck with a chain 31. If the display board 9 is too small, the mode of display may be changed accordingly from that shown in FIG. 5. For example, the bold and slim line symbols may be deleted such that the user can tell only which stage the process is in. Exchange of signals between the main body and the remote controller may be effected through a cable although it is much less convenient than by a wireless transmission method disclosed above such as by infrared and ultrasonic beams.

A still another embodiment of the remote controller 101 according to the present invention is shown in FIG. 10. A remote controller according to this embodiment may be called a desk top type and is characterized in that its scanner is separable from the rest. Reference being made to both FIG. 10A which is a perspective view and FIG. 10B which is a horizontal side sectional view, a remote controller of the desk top type according to this embodiment comprises a top member 32 and a bottom member 33 which are both cylindrical and in a mutually rotatable relationship. The bottom member 33 houses a display board 9, a beeper 10 and a volume control switch 36 for the beeper 10; while the rotatable top member houses the transmitter 7 and the receiver 8. One of the advantages of the remote controller according to this embodiment is that exchange of signals between the remote controller 101 and the main body control means 112 can be effected more reliably because the top member 32 can be rotated for the best results with respect to the main body 103. Numeral 35 indicates a scanner housing which may contain a battery for the scanner 6. It is with an elongated cylindrical handle 37 and there is provided a circular hole to match this handle 37 at the center of the top surface of the top member 32 such that the scanner housing 35 can be put safely on top of the remote controller by inserting the handle 37 into this hole.

The method of and program for correcting, or adjusting the computer cooking programs according to the number of portions or calorie value desired by the user are not intended to limit the scope of the present invention. If it is important to reduce the capacity of the memory means required for this mode of operation, for example, the flow chart of FIG. 7 may be modified such that the program will accept only a discrete set of values as input. For each recipe, for example, data corresponding only to 0.5, 1, 1.5, . . . 10 portions or 50, 100, 150, . . . , 1500 calories per person may be made available. In short, modifications and variations of the present invention which may be apparent to a person skilled in the art are intended to be included within the scope of this invention.

What is claimed is:

1. An electronically controlled oven comprising a main body and a remote controller which is physically separable from said main body, said remote controller including a start button means, a scanner means for scanning a code and outputting a code signal indicative of said scanned code, a transmitter means for transmitting electromagnetic wave signals, and a processing means for receiving said code signal from said scanner for a predetermined period of time after said start button means is operated, judging whether said received code signal is in a transmittable form or not, and causing said transmitter means tp transmit said code signal a predetermined number of times repeatedly if said received code signal is judged to be in a transmittable form, said main body including a receiver means for receiving said code signal transmitted form said transmitter means and converting said received code signal into an electric code signal, memory means for storing cooking programs, control means for retrieving from said memory means a particular one of said stored cooking programs corresponding to said electric code signal indicative of said received code signal and outputting heater-controlling signals describing said particular one of said cooking programs, a cooking chamber, heater means for heating items inside said cooking chamber, and heater-control means for receiving said heater-controlling signals and controlling the operation of said heater means according to said received heater-controlling signals.

2. The oven of claim 1 wherein said scanned code is a bar code and said transmitter means transmits said code signal as an infrared signal.

3. The oven of claim 1 wherein said control means also outputs display signals according to said cooking program, and said oven further comprises display means for displaying information according to said display signals.

4. The oven of claim 3 wherein said display means are included in said main body and receive said display signals from said control means.

5. An electronically controlled over comprising a main body, a remote controller which is physically separable from said main body, said remote controller including a scanner means for scanning a code and outputting a code signal inactive of said scanned code, a first transmitter means for transmitting electromagnetic wave signals, as display means, and a processing means connected to said scanner means to receive said code signal outputted from said scanner means, said processing means being so programmed as to judge whether said received code signal is in a transmittable form and to cause said transmitter means to transmit said code signal electromagnetically if said received code signal is judged transmittable, said main body including a first receiver means for receiving said code signal transmitted from said first transmitter means and converting said received code signal into an a electric code signal, memory means storing cooking programs and display programs of time sequences individually associated with said cooking programs.

a cooking chamber, heater means for heating items inside said cooking chamber, control means so connected as to receive said electric code signal and so programmed as to retrieve from said memory means a particular one of said stored cooking programs corresponding to said electric code signal and one of said display programs associated with said particular one of said cooking programs, said control means being further so programmed as to output heater-controlling signals according to said retrieved cooking program, heater-control means so connected as to receive said heater-controlling signals and to control operations of said heater means according to said received heater-controlling signals, and a second transmitter means for transmitting signals electromagnetically, said control means being further so programmed as to cause said second transmitter means to transmit display signals according to said retrieved display program, said remote controller further including a second receiver means for receiving said display signals, converting said display signals into electrical display signals and transmitting said electrical display signals to said processing means, and said processing means being further so programmed as to display the progress in the execution of said retrieved program in said display means in response to said received display signals.

6. The oven of claim 5 wherein said remote controller further includes a message memory means storing messages to be displayed in said display means, said processing means being further programed to select one of said messages according to said received display signal and to cause said selected one of said messages to be displayed in said display means.

7. The oven of claim 5 wherein said display means include a sound making device.

8. The oven of claim 5 wherein said first and second transmitter means each include an infrared wave signal transmitter.

9. The oven of claim 5 wherein said remote controller comprises a lower structure which includes said display means, and upper structure which includes said second receiver means and said first transmitter means and is connected rotatably to said lower structure, and a scanner housing which contains said scanner means and is separable from said lower and upper structures.

10. An electronically controlled oven comprising a main body, a remote controller which is physically separable from said main body, said remote controller including a scanner means for scanning a code and outputting a code signal indicative of said scanned code, a first transmitter means for transmitting electromagnetic wave signals, a display means, and a processing means connected to said scanner means to receive said code signal outputted form said scanner means, said processing means being so programed as to judge whether said received code signal is in a transmittable form and to cause said transmitter means to transmit said code signal electromagnetically if said received code signal is judged transmittable, said main body including a first receiver means for receiving said code signal transmitted form said first transmitter means and converting said received code signal into an electric code signal, memory means storing cooking programs and display programs of time sequences individually associated with said cooking programs, a cooking chamber, heater means for heating items inside said cooking chamber, control means so connected as to receive said electric code signal and so programmed as to retrieve from said memory means a particular one of said stored cooking programs corresponding to said electric code signal and one of said display programs associated with said particular one of said cooking programs, said control means being further so programmed as to output heater-controlling signals according to said retrieved cooking program, heater-control means so connected as to receive said heater-controlling signals and to control operations of said heater means according to said received heater-controlling signals, and a second transmitter means for transmitting signals electromagnetically, said control means being further so programmed as to cause said second transmitter means to transmit display signals according to said retrieved display program, said remote controller further including a second receiver means for receiving said display signals, converting said display signals into electrical display signals and transmitting said electrical display signals to said processing means, said remote controller further including input means for receiving user's commands for having data related to said retrieved program displayed in said display means and/or modifying said retrieved program, and said processing means being further so programmed as to cause said display means to make a display according to said display signal received by said second receiver means and to cause said first transmitter means to transmit command signals in response to said commands received by said input means.

11. The oven of claim 10 wherein said input means include number keys.

12. The oven of claim 11 wherein said input means further include a calorie check button means, said processing means being further so programmed as to cause a calorie value associated with said retrieved program to be displayed if said calorie check button means is operated.

13. The oven of claim 12 wherein said input means further include a calorie input button means for transmitting to said processing means a calorie value signal indicative of a desired calorie value formed by said number keys, said processing means being further so programmed as to automatically modify said retrieved program in response to said calorie value signal according to said inputted desired calorie value and to send, in response to a start command, a start signal through said first transmitter means to said control means to thereby start operating said heater-control means according to said modified program and to cause a new display signal associated with said modified program to be transmitted from said second transmitter means.

14. The oven of claim 11 wherein said input means further include a portion input button means, said processing means being further so programmed as to modify said retrieved program, if said portion input button is operated and a desired portion number different from an intented number of portion associated with said retrieved program is inputted through said number keys, according to said desired portion number, to cause said desired portion number to be displayed in said display means and to cause said heater-control means to start operating according to said modified retrieved program in response to a start command.

* * * * *